US011859303B2

(12) United States Patent
Jia et al.

(10) Patent No.: US 11,859,303 B2
(45) Date of Patent: Jan. 2, 2024

(54) PLATING APPARATUS

(71) Applicant: ACM Research (Shanghai) Inc., Shanghai (CN)

(72) Inventors: Zhaowei Jia, Shanghai (CN); Hongchao Yang, Shanghai (CN); Chenhua Lu, Shanghai (CN); Jian Wang, Shanghai (CN); Hui Wang, Shanghai (CN)

(73) Assignee: ACM RESEARCH (SHANGHAI), INC., Shanghai (CN)

( * ) Notice: Subject to any disclaimer, the term of this patent is extended or adjusted under 35 U.S.C. 154(b) by 138 days.

(21) Appl. No.: 16/643,349

(22) PCT Filed: Aug. 30, 2017

(86) PCT No.: PCT/CN2017/099572
§ 371 (c)(1),
(2) Date: Feb. 28, 2020

(87) PCT Pub. No.: WO2019/041154
PCT Pub. Date: Mar. 7, 2019

(65) Prior Publication Data

US 2020/0354851 A1 Nov. 12, 2020

(51) Int. Cl.
*C25D 5/08* (2006.01)
*C25D 13/22* (2006.01)
(Continued)

(52) U.S. Cl.
CPC ..... *C25D 5/08* (2013.01); *C25D 13/22* (2013.01); *C25D 17/002* (2013.01); *C25D 17/06* (2013.01); *C25D 21/12* (2013.01)

(58) Field of Classification Search
None
See application file for complete search history.

(56) References Cited

U.S. PATENT DOCUMENTS 6,261,426 B1 * 7/2001 Uzoh ..... C25D 5/08 204/224 R
6,517,698 B1 * 2/2003 Johnson ..... C25D 17/02 205/148
(Continued)

FOREIGN PATENT DOCUMENTS

CN 106480491 A 3/2017
CN 106929900 A 7/2017
(Continued)

OTHER PUBLICATIONS

International Search Report issued in corresponding International Application No. PCT/CN2017/099572, dated Apr. 27, 2018 (4 pages).
(Continued)

*Primary Examiner* — Louis J Rufo
(74) *Attorney, Agent, or Firm* — Osha Bergman Watanabe & Burton LLP

(57) ABSTRACT

A plating apparatus for depositing metal on a substrate, comprising a membrane frame (14), a catholyte inlet pipe (30) and a center cap (40). The membrane frame (14) has a center passage (144) which passes through the center of the membrane frame (14). The catholyte inlet pipe (30) is connected to the center passage (144) of the membrane frame (14). The center cap (40) is fixed at the center of the membrane frame (14) and covers over the center passage (144) of the membrane frame (14). The top of the center cap (40) has a plurality of first holes (42). The catholyte inlet pipe (30) supplies catholyte to the center cap (40) through the center passage (144) of the membrane frame (14), and the catholyte is supplied to a center area of the substrate through the first holes (42) of the center cap (40).

37 Claims, 24 Drawing Sheets

(51) Int. Cl.

| | |
|---|---|
| ***C25D 17/00*** | (2006.01) |
| ***C25D 17/06*** | (2006.01) |
| ***C25D 21/12*** | (2006.01) |

(56) References Cited

U.S. PATENT DOCUMENTS

| | | | | |
|---|---|---|---|---|
| 8,496,789 | B2 * | 7/2013 | McHugh | C25D 17/005 204/263 |
| 9,920,448 | B2 | 3/2018 | McHugh et al. | |
| 2001/0017105 | A1 | 8/2001 | Ishida et al. | |
| 2002/0027080 | A1 | 3/2002 | Yoshioka et al. | |
| 2002/0053509 | A1 * | 5/2002 | Hanson | C23C 18/1632 204/224 R |
| 2003/0057093 | A1 * | 3/2003 | Klocke | C25D 13/22 204/471 |
| 2012/0000786 | A1 | 1/2012 | Mayer et al. | |
| 2012/0292181 | A1 * | 11/2012 | McHugh | C25D 17/001 204/260 |
| 2017/0058424 | A1 | 3/2017 | Wilson et al. | |

FOREIGN PATENT DOCUMENTS

| | | | |
|---|---|---|---|
| TW | I281516 | B | 5/2007 |
| TW | I572749 | B | 3/2017 |
| WO | 2005007933 | A1 | 1/2005 |

OTHER PUBLICATIONS

Written Opinion issued in corresponding International Application No. PCT/CN2017/099572, dated Apr. 27, 2018 (3 pages).
Office Action issued in corresponding TW Application No. 108106900 dated Jul. 28, 2022 (5 pages).

* cited by examiner

PLATING APPARATUS

FIELD OF THE INVENTION

The present invention generally relates to IC semiconductor manufacturing equipment, and more particularly to a plating apparatus for metal deposition.

BACKGROUND

In the field of semiconductor manufacturing, plating is a commonly used method to deposit metal films on a substrate. Especially, in the advanced packaging technology, copper pillars, solder bumps and the like which are used to realize chip substrate interconnection are formed on a substrate generally by electroplating since electroplating has advantages of simple process, low cost, easy to mass production, etc. Unfortunately, at present, plating apparatuses on the market have a common defect that is low plating rate. Low plating rate means low production efficiency, which is unacceptable for semiconductor enterprises. For semiconductor enterprises, the largest investment cost comes from a large number of manufacturing equipment. Therefore, how to optimize the equipment capacity is the most effective way to reduce cost.

To improve the plating rate, the mass transfer needs to be enhanced. FIG. 23 shows an abnormal shape of a copper pillar. FIG. 24 shows a normal shape of copper pillars. The abnormal shape of the copper pillar is caused when the mass transfer is not enough and turns out to be the limit of deposition rate. In plating, when the mass transfer is not enough, for the copper pillar formed in a pillar via, the plating rate is higher at the area where the electrolyte flow is stronger, and relatively, the plating rate at the other area is low. Finally, the shape of the copper pillar is abnormal after the end of plating. It can be seen that for obtaining the normal shape of copper pillars on the entire substrate, the mass transfer should be big enough within everywhere of the copper pillar and also should be big enough across the entire substrate to ensure every copper pillar is normal and all of the copper pillars on the substrate have good uniformity.

Generally, there is a plurality of ways to enhance the mass transfer, such as optimizing plating solution chemical formula, increasing plating solution temperature, enhancing plating solution agitation, etc. Thereinto, a common way to enhance plating solution agitation includes: increasing substrate rotation speed, using an agitator in the electrolyte, increasing electrolyte flow rate. But the substrate rotation speed increase will cause the substrate edge more plating and the substrate center less plating due to centrifugal force. So simply increasing substrate rotation speed will result in the plated film non-uniformity. The agitator normally is a movable paddle. The agitator moves back and forth at high frequency, which will easily trap air bubbles into the electrolyte. The air bubbles on the substrate block the electrolyte going into device structures or pillar vias. In regard to increasing electrolyte flow rate, because flow rate increase is supplied to the entire substrate, the flow will be distributed centrically and the flow will spin out from the substrate center to substrate edge. Therefore, the substrate center will have lower fresh electrolyte supplement.

For supplying fresh electrolyte and additives in time to meet requirement of high current density, more electrolyte should be supplied to the center of the substrate. Otherwise, the shape of pillars at the center of the substrate is abnormal or the height of the pillars will be lower. In fact, it is incapable of improving the plating rate simply by increasing the current density, because current density across the entire substrate is non-uniform, which is higher current density at the substrate periphery due to a phenomenon called "terminal effect". This current density non-uniformity results in higher plating rate at the substrate edge and relatively lower plating rate at the substrate center, which further results in the plated film non-uniformity. Due to the current density non-uniform across the entire substrate, if it is simply to increase the electrolyte flow rate for raising the plating rate without any structure improvement, it will aggravate the plated film non-uniformity.

For a plating apparatus, although chemical is a factor which may affect the plating rate, the plating rate is mainly related to the electrolyte flow rate across the entire substrate. In order to reach high plating rate, a large and stable electrolyte flow supplied to the substrate is necessary. But it is difficult to control the electric field and the electrolyte flow uniformity across the entire substrate once the electrolyte flow rate is increased.

SUMMARY

It is an object of the present invention to disclose a plating apparatus for depositing metal on a substrate with high plating rate and uniform plated film on the entire substrate.

According to an embodiment of the present invention, a plating apparatus comprises a membrane frame, a catholyte inlet pipe and a center cap. The membrane frame has a center passage which passes through the center of the membrane frame. The catholyte inlet pipe is connected to the center passage of the membrane frame. The center cap is fixed at the center of the membrane frame and covers over the center passage of the membrane frame. The top of the center cap has a plurality of first holes. The catholyte inlet pipe supplies catholyte to the center cap through the center passage of the membrane frame, and the catholyte is supplied to a center area of the substrate through the first holes of the center cap.

As described above, the plating apparatus of the present invention utilizes the center cap to improve the uniformity of the electrolyte flow and the electric field at the substrate center area, which further improves the plated film uniformity on the entire substrate. Therefore, while plating, the flow rate of the catholyte in the catholyte inlet pipe can be increased so that the plating rate is raised.

DETAILED DESCRIPTION

Figure 1:
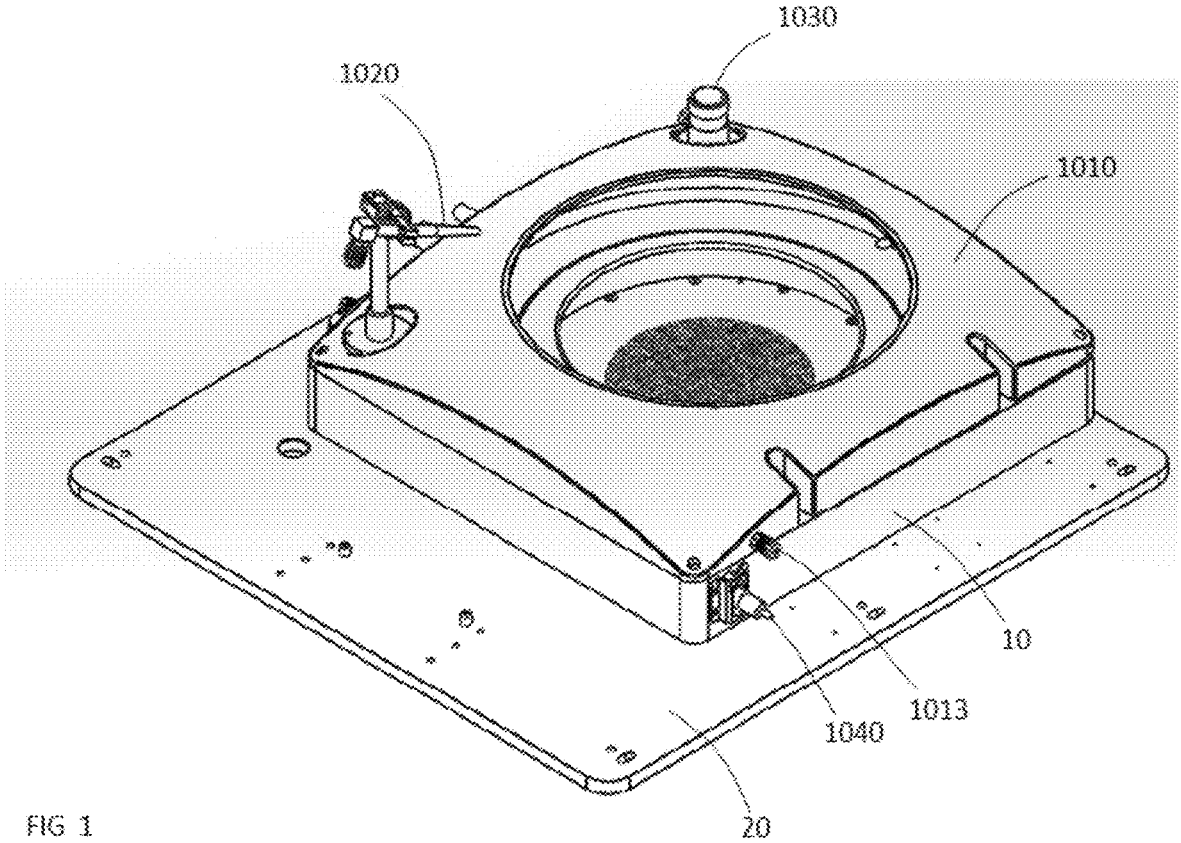
FIG. 1 is a perspective view of a plating apparatus according to the present invention.

Referring to FIG. 1 to FIG. 7, a plating apparatus according to an exemplary embodiment of the present invention is illustrated. The plating apparatus includes a chamber body 10. The chamber body 10 is supported by a pedestal 20. The chamber body 10 is divided into an anode chamber 11 and a cathode chamber 12. The anode chamber 11 and the cathode chamber 12 are separated by a membrane 13 which is positioned on a membrane frame 14.

The anode chamber 11 is divided into multiple anode zones 111 and every two adjacent anode zones 111 are separated by a vertically arranged partition 112. The material of the partitions 112 is selected from non-conductive and chemical resistance plastics. The partitions 112 separate the electric fields and restrict the electrolyte flow fields. In an embodiment, as an example, no limit to the present invention, the anode chamber 11 is divided into two anode zones 111. Each anode zone 111 accommodates an annular anode 113 which is connected to an independently controlled power supply channel 114. Plating current or potential is supplied independently to each of the annular anodes 113 by the power supply channels 114. Every power supply channel 114 is connected to a power supply which can be a DC or pulse power supply. The power supply channels 114 are housed in a protection shield 115. The annular anodes 113 are made of soluble materials such as copper (Cu), nickel (Ni), stannum (Sn). Optionally, the annular anodes 113 are made of inert materials. Every anode zone 111 has an independent anolyte inlet 116 which is connected to an electrolyte flow control device for supplying anolyte to the anode zone 111. Meanwhile, every anode zone 111 has an independent anolyte outlet 117 for discharging aged electrolyte, decomposition products, and particles from each anode zone 111.

The membrane 13 is a cation membrane for Cu, Ni, Sn plating. Besides, the membrane 13 may also be a proton exchange membrane or a normal membrane with textures for special using in alloy plating. The membrane 13 is attached on the membrane frame 14. An annular fixing plate 15 is used to fix the peripheral edge of the membrane 13 on the membrane frame 14. A first seal ring 16 is set between the peripheral edge of the membrane 13 and the membrane frame 14. A second seal ring 17 is set between the peripheral edge of the membrane 13 and the annular fixing plate 15. A plurality of fixing members 18, such as screws, are used to fix the membrane frame 14, the first seal ring 16, the membrane 13, the second seal ring 17 and the annular fixing plate 15 on the chamber body 10 to separate the anode chamber 11 and the cathode chamber 12. A third seal ring 19 is set between the annular fixing plate 15 and the chamber body 10.

A catholyte inlet pipe 30 is mounted at the center of the membrane frame 14 for supplying catholyte to the cathode chamber 12. A fourth seal ring 31 is set between the inner edge of the membrane 13 and the catholyte inlet pipe 30. A fifth seal ring 32 is set between the inner edge of the membrane 13 and the membrane frame 14.

Figure 4:
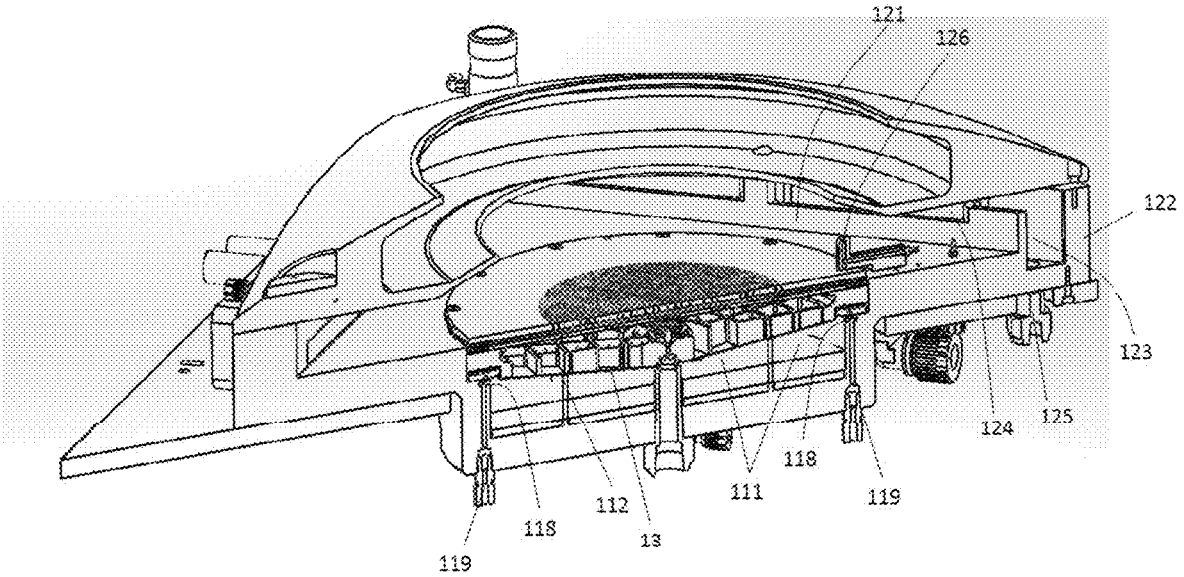
FIG. 4 is another cross-sectional view of the plating apparatus shown in FIG. 1.

As shown in FIG. 4, there is no complete isolation between the anode zones 111. There is a distance between the top of the partitions 112 and the membrane 13 for gas bubbles passing through. A side wall of the anode chamber 11 defines a plurality of discharge holes 118 approaching to the membrane 13. Every discharge hole 118 is connected to a discharge passage 119. The gas bubbles in the anode zones 111 are collected and guided by the membrane 13 to the discharge holes 118 and discharged out from the discharge passages 119.

Figure 20:
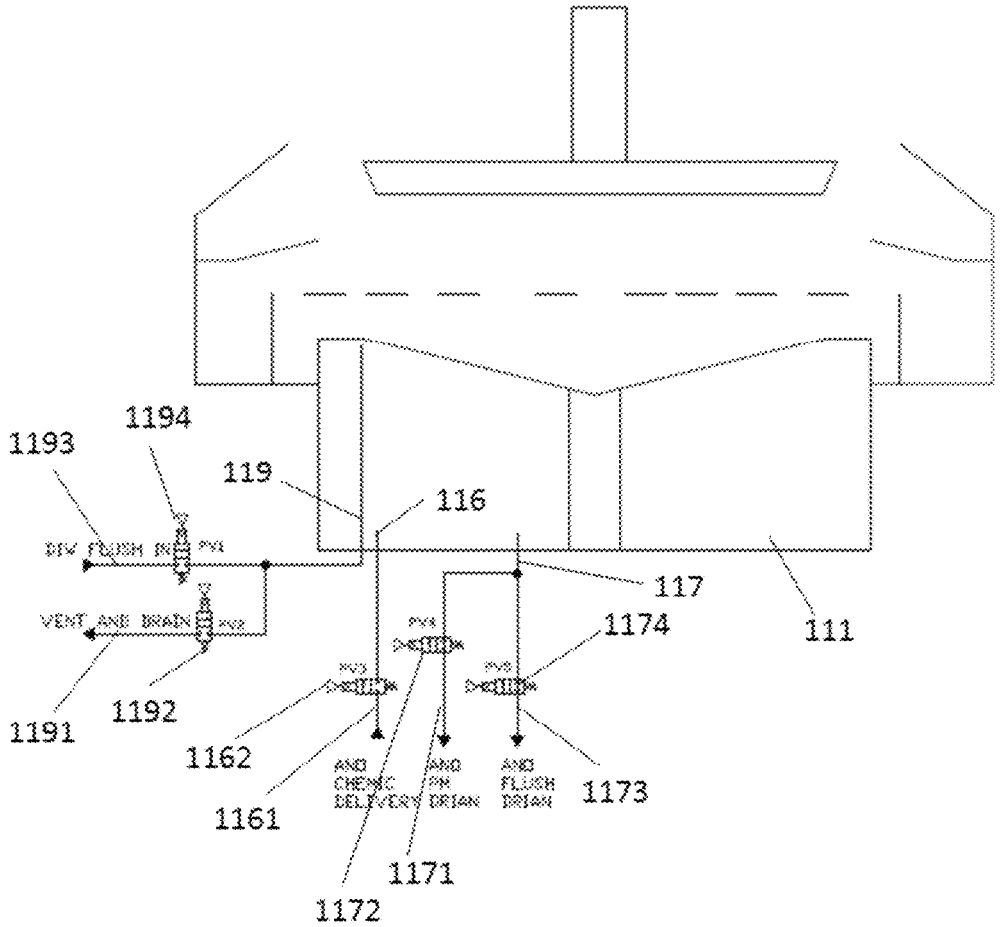
FIG. 20 is a simplified schematic view of the plating apparatus.

Please refer to FIG. 20 which is a simplified schematic view of the plating apparatus, mainly illustrating the anode electrolyte circulation and automatic cleaning of the annular anodes 113. While plating, a third valve 1162 which is set on an anolyte inlet pipe 1161 is opened. The anolyte inlet pipe 1161 is connected to the anolyte inlet 116. Meanwhile, a second valve 1192 which is set on a discharge pipe 1191 is opened. The discharge pipe 1191 is connected to the discharge passage 119. The anode electrolyte is supplied to the anode zone 111 through the anolyte inlet pipe 1161 and the anolyte inlet 116 and then discharged through the discharge hole 118, the discharge passage 119 and the discharge pipe 1191 to realize the anode electrolyte circulation. When the plating process reaches to conditions which are set in advance, for example, process time over 200 hours, it needs to clean the annular anodes 113. For cleaning the annular anode 113, firstly, the third valve 1162 and the second valve 1192 are closed to stop anode electrolyte circulation. Then, a fourth valve 1172 which is set on an anolyte outlet pipe 1171 is opened. The anolyte outlet pipe 1171 is connected to the anolyte outlet 117. The anode electrolyte in the anode zone 111 is drained through the anolyte outlet 117 and the anolyte outlet pipe 1171. Then, the fourth valve 1172 is closed. A first valve 1194 which is set on a DIW (deionized water) inlet pipe 1193 and a fifth valve 1174 which is set on a DIW outlet pipe 1173 are opened. The DIW inlet pipe 1193 is connected to the discharge passage 119. The DIW outlet pipe 1173 is connected to the anolyte outlet 117. DIW is supplied to the anode zone 111 of the anode chamber 11 to flush the annular anode 113 through the DIW inlet pipe 1193, the discharge passage 119 and the discharge hole 118 and then drained through the anolyte outlet 117 and the DIW outlet pipe 1173 to remove anode slime. The flow rate of DIW is in the range of 0.5 lpm to 10 lpm. There is another way to clean the annular anode 113, including the following steps: open the first valve 1194 to supply a certain amount of DIW into the anode chamber 11; close the first valve 1194; open the fifth valve 1174 to drain the DIW and remove anode slime; close the fifth valve 1174; repeat these steps until the annular anode 113 are cleaned. In the FIG. 20, it just shows one anode zone 111. It should be realized that the anode electrolyte circulation and automatic cleaning of the annular anodes 113 in the other anode zone 111 are the same as that showed one.

Figure 8:
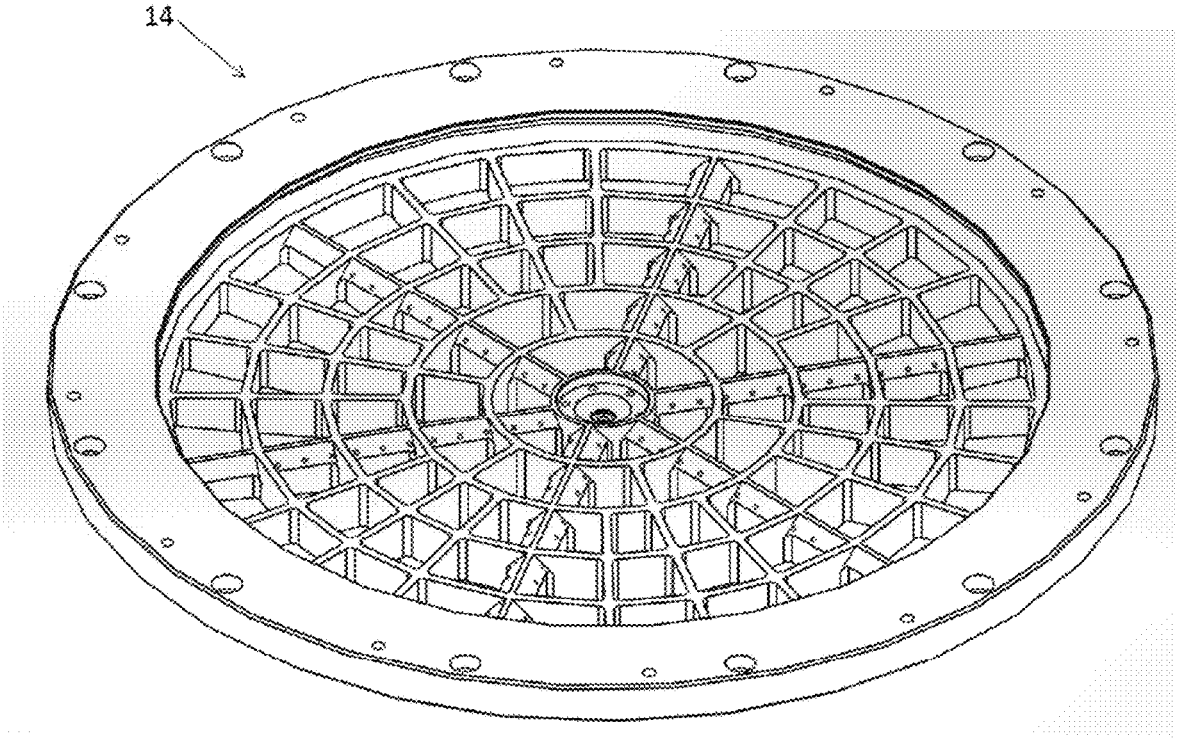
FIG. 8 is a perspective view of a membrane frame of the plating apparatus.
Figure 9:
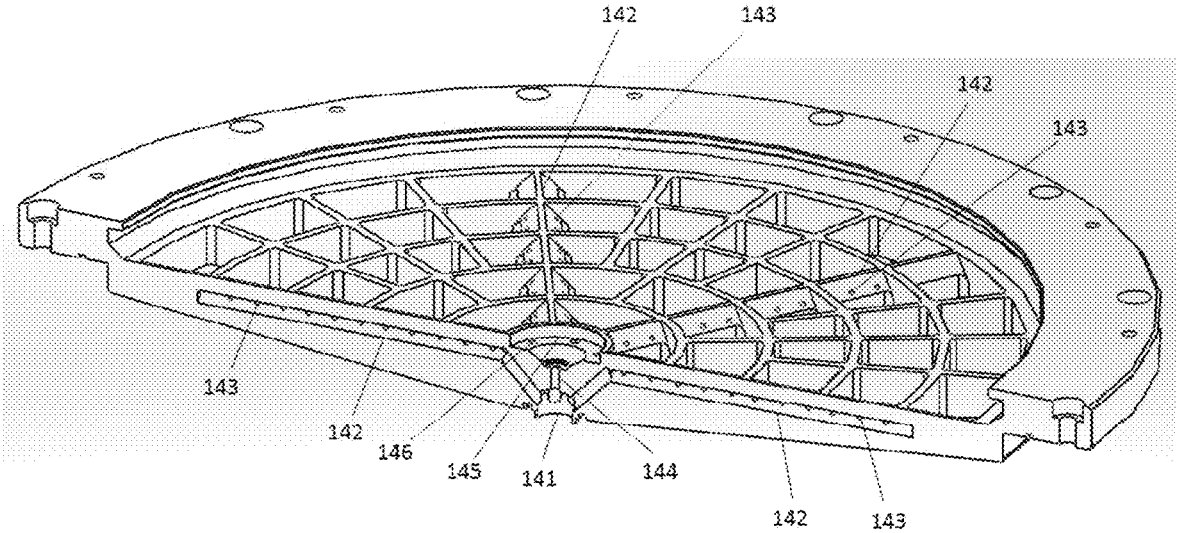
FIG. 9 is a cross-sectional view of the membrane frame shown in FIG. 8.

The membrane frame 14 with the membrane 13 is horizontally arranged for separating the anode chamber 11 and the cathode chamber 12. Referring to FIG. 8 and FIG. 9, the membrane frame 14 is a rigid perforated or meshed frame. The membrane frame 14 is substantially dish-shaped and has a catholyte inlet 141 at the center thereof. The catholyte inlet 141 is connected to the catholyte inlet pipe 30. The membrane frame 14 further has a plurality of branch pipes 142 extending from the center of the membrane frame 14 to the edge of the membrane frame 14. Every branch pipe 142 is connected to the catholyte inlet 141. Every branch pipe 142 has a plurality of spray holes 143. The diameter of the plurality of spray holes 143 on each branch pipe 142 can be the same or not. Since on the substrate, with the increase of radius, the area increases so that need more flow to meet the plating mass transfer. Therefore, the diameter of the spray holes 143 gradually increases from the center to edge of the membrane frame 14. For example, corresponding to the radius of 50 mm, the diameter of the spray holes 143 is 2 mm, and corresponding to the radius of 100 mm, the diameter of the spray holes 143 is 4 mm, and corresponding to the radius of 150 mm, the diameter of the spray holes 143 is 6 mm, and so on. In another way, the density of the spray holes 143 on each branch pipe 142 can be the same or not. The density of the spray holes 143 gradually increases from the center to edge of the membrane frame 14. According to an exemplary embodiment, the opening direction of every spray hole 143 is tilted relative to a vertical plane for avoiding the catholyte spraying to the same place to cause impact. The plurality of spray holes 143 on each branch pipe 142 can be divided into two groups. The opening directions of the two groups of spray holes 143 are opposite. Optionally, the opening directions of every two adjacent spray holes 143 on each branch pipe 142 are opposite. In an embodiment, the membrane frame 14 has six branch pipes 142 for flow uniform distribution.

The membrane frame 14 has a center passage 144 passing through the center of the membrane frame 14. A holding cavity 145 is defined at the center of the membrane frame 14. A bottom end of the center passage 144 is connected to the catholyte inlet 141 and a top end of the center passage 144 is connected to the holding cavity 145. The membrane frame 14 further defines a plurality of fixing holes 146 in the holding cavity 145.

Figure 10:
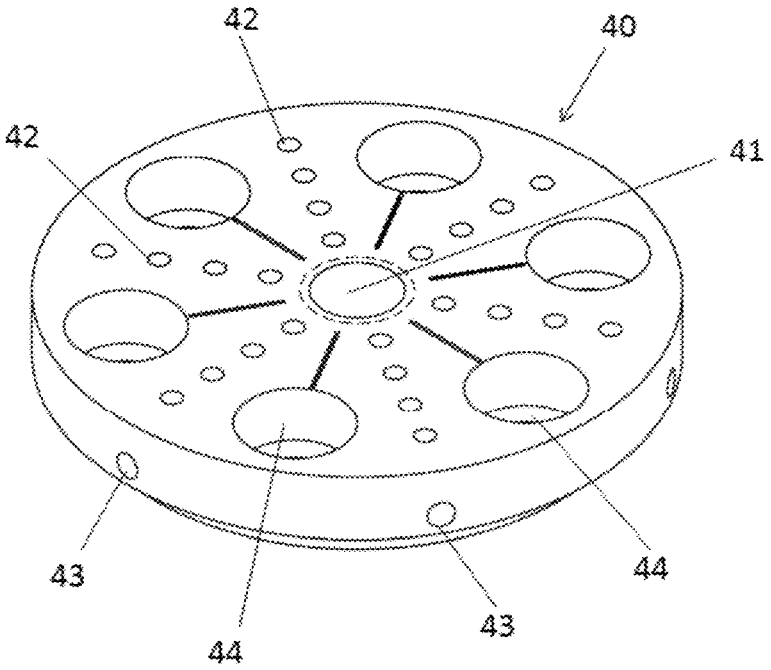
FIG. 10 is a perspective view of a center cap of the plating apparatus.
Figure 11:
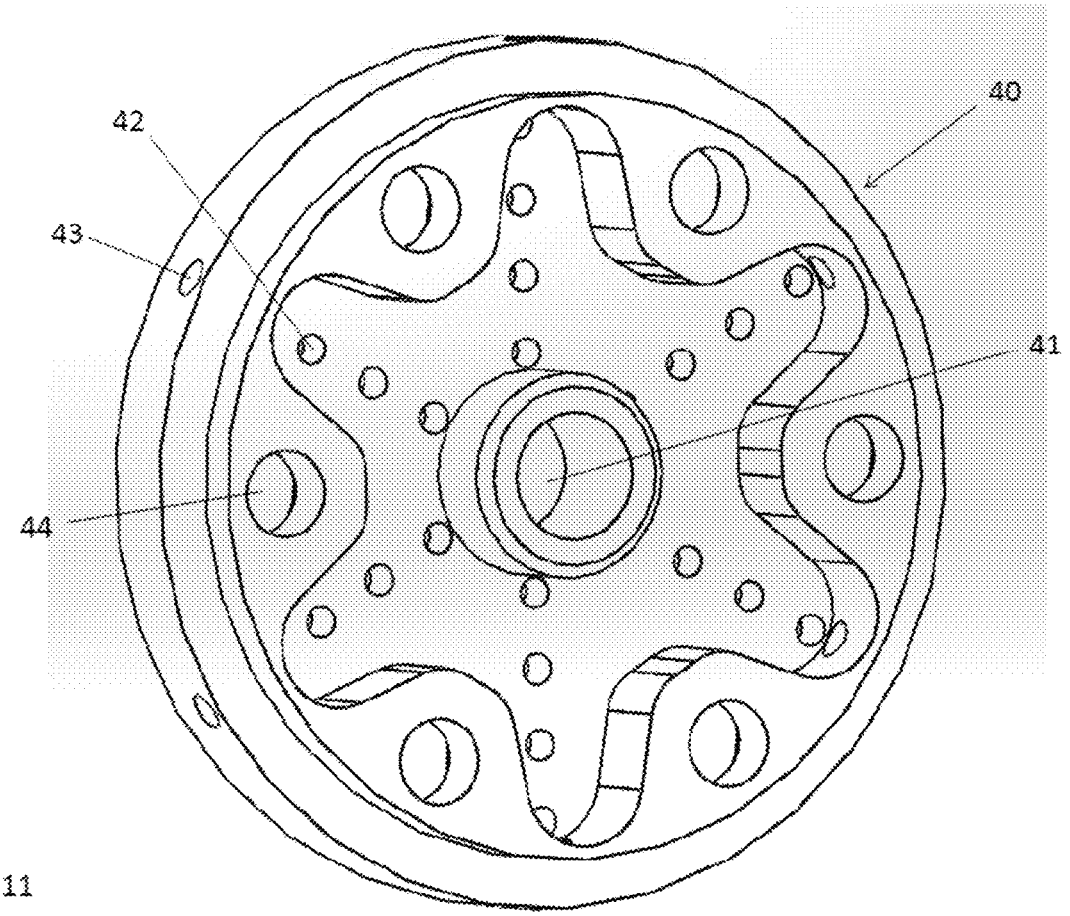
FIG. 11 is another perspective view of the center cap.

Because the plating at the substrate center range of which diameter is about 0-60 mm is difficult to control, especially the uniformity of the electrolyte flow and the electric field at the substrate center range being difficult to control, for solving this problem and breaking through the limitation of the plating at the center range to the entire plating, the plating apparatus of the present invention further includes a center cap 40 and an adjustable member 50. The center cap 40 is fixed at the holding cavity 145 of the membrane frame 14. Referring to FIG. 10 and FIG. 11, the center cap 40 has a through-hole 41 defined at the center of the center cap 40. The center cap 40 has a plurality of first holes 42 which are arranged radially on the top of the center cap 40 for flow uniform distribution. The diameter of the first holes 42 can be the same or not. Since on the substrate, with the increase of radius, the area increases so that need more flow to meet the plating mass transfer. Therefore, the diameter of the first holes 42 gradually increases from the center to edge of the center cap 40. In another way, the density of the first holes 42 on the center cap 40 can be the same or not. The density of the first holes 42 gradually increases from the center to edge of the center cap 40. Preferably, a side wall of the center cap 40 has a plurality of second holes 43. The opening direction of every second hole 43 is obliquely upward. In plating, if only the top of the center cap 40 has the first holes 42, when the catholyte is sprayed to the cathode chamber 12 from the first holes 42, there may be a cavitation formed in the area around the center cap 40 and the electrolyte flow around the center cap 40 will be not enough. This problem is solved by setting the second holes 43 on the side wall of the center cap 40. The diameter or density of the second holes 43 distributed on the side wall of the center cap 40 can be different from the diameter or density of the first holes 42 distributed on the top of the center cap 40.

The top of the center cap 40 has a plurality of mounting holes 44. The center cap 40 is fixed at the holding cavity 145 of the membrane frame 14 by using a plurality of screws. The screws are respectively inserted in the mounting holes 44 of the center cap 40 and the fixing holes 146 of the membrane frame 14. An o-ring 45 is set between the center cap 40 and the membrane frame 14. The catholyte is supplied to the branch pipes 142 and the center cap 40 through the catholyte inlet pipe 30, the catholyte inlet 141 and the center passage 144. The catholyte is sprayed into the cathode chamber 12 through the spray holes 143 on the branch pipes 142, the first holes 42 and the second holes 43 on the center cap 40. The flow rate of the catholyte in the catholyte inlet pipe 30 is capable of reaching more than 30 LPM (Liter per Minute), generally in the range of 2 LPM to 60 LPM. Although the flow rate of the catholyte is increased, due to the center cap 40 and the novel design of the branch pipes 142 of the membrane frame 14, the uniformity of the electrolyte flow and the electric field across the entire substrate is improved, which further improves the plated film uniformity on the entire substrate. Besides, since a large and stable electrolyte flow can be obtained, the plating rate is raised comparing to a conventional plating apparatus. If there is no center cap 40, because the catholyte rushes upward directly from the catholyte inlet pipe 30 and the catholyte inlet 141 of the membrane frame 14, the flow is fast and the impact force is great, causing jetting phenomenon at the substrate center area, further causing the shape of plated pillars at the substrate center area is abnormal. By setting the center cap 40 and increasing the number of the first holes 42 and the second holes 43, the flow is slow down and the impact force is small. On the other hand, the flow of the catholyte can be adjusted by the distribution of the first holes 42 and the second holes 43, further improving the uniformity of catholyte supplied to the substrate center area.

Figure 12:
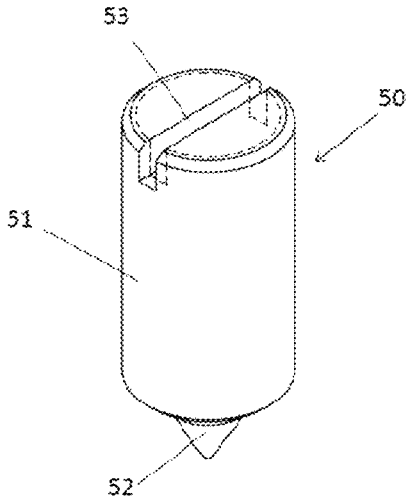
FIG. 12 is a perspective view of an adjustable member of the plating apparatus.
Figure 13:
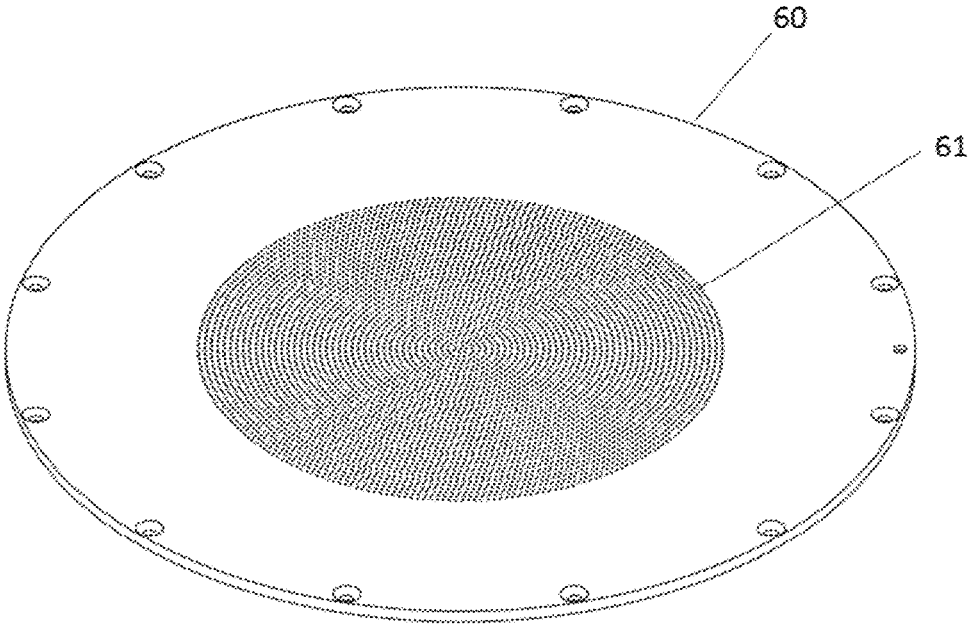
FIG. 13 is a perspective view of a first diffusion plate of the plating apparatus.
Figure 14:
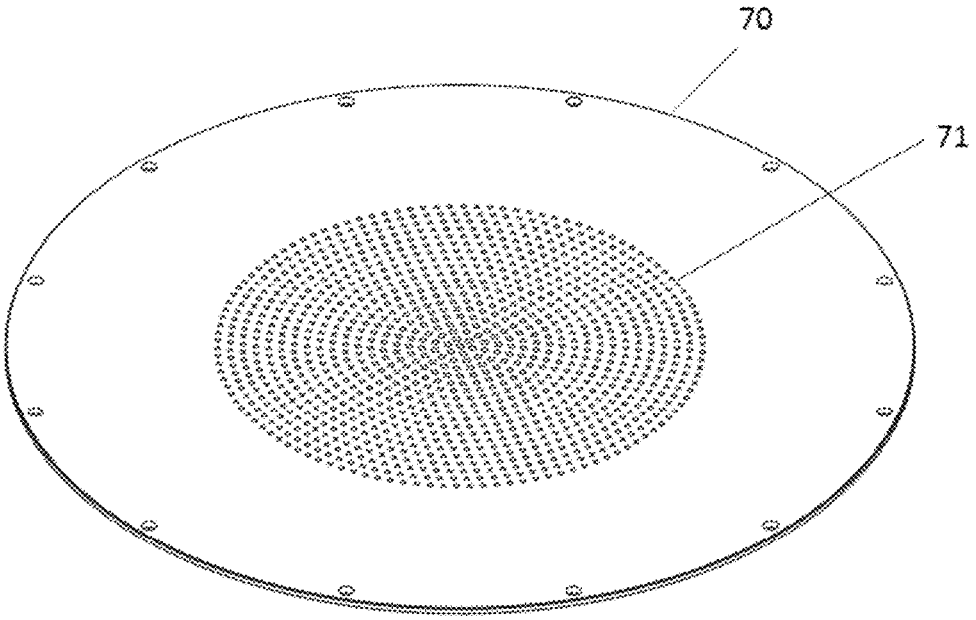
FIG. 14 is a perspective view of a second diffusion plate of the plating apparatus.

Referring to FIG. 12, the adjustable member 50 is configured to regulate the flow of catholyte supplied to the center cap 40, further regulating the flow of catholyte supplied to the center range of the substrate. The adjustable member 50 is inserted in the through-hole 41 of the center cap 40 and located at the top end of the center passage 144 of the membrane frame 14 for center flow control. The adjustable member 50 is capable of completely blocking the top end of the center passage 144 of the membrane frame 14 so that the catholyte cannot be supplied to the center cap 40. By gradually raising the adjustable member 50 upward, the top opening of the center passage 144 is gradually opened so that the catholyte is supplied to the center cap 40 through a gap 147 formed between the adjustable member 50 and the center passage 144. Therefore, the flow of catholyte supplied to the center range of the substrate is capable of being regulated by changing the size of the gap 147. The size of the gap 147 is capable of being changed by raising or descending the adjustable member 50. According to an embodiment, the adjustable member 50 has a base body 51 and a blocking component 52 formed at the bottom of the base body 51. The base body 51 is cylinder-shaped. The blocking component 52 is inverted cone-shaped. The top of the base body 51 defines a groove-shaped opening 53 for conveniently rotating the adjustable member 50 by using a tool such as a screw driver so that the adjustable member 50 moves upward or downward in the through-hole 41 of the center cap 40 for adjusting the size of the gap 147, regulating the flow of catholyte supplied to the center cap 40, further regulating the flow of catholyte supplied to the center range of the substrate. It can be seen that the flow of catholyte supplied to the center cap 40 is controlled independently by the adjustable member 50. The adjustable member 50 can be a set screw. Furthermore, when the flow of catholyte in the catholyte inlet pipe 30 is given, if the flow of catholyte supplied to the center cap 40 is small, then the flow of catholyte supplied to the branch pipes 142 of the membrane frame 14 will be large, conversely, if the flow of catholyte supplied to the center cap 40 is large, then the flow of catholyte supplied to the branch pipes 142 of the membrane frame 14 will be small. Therefore, the flow of catholyte supplied to the center cap 40 and the flow of catholyte supplied to the branch pipes 142 of the membrane frame 14 are adjustable.

Figure 21:
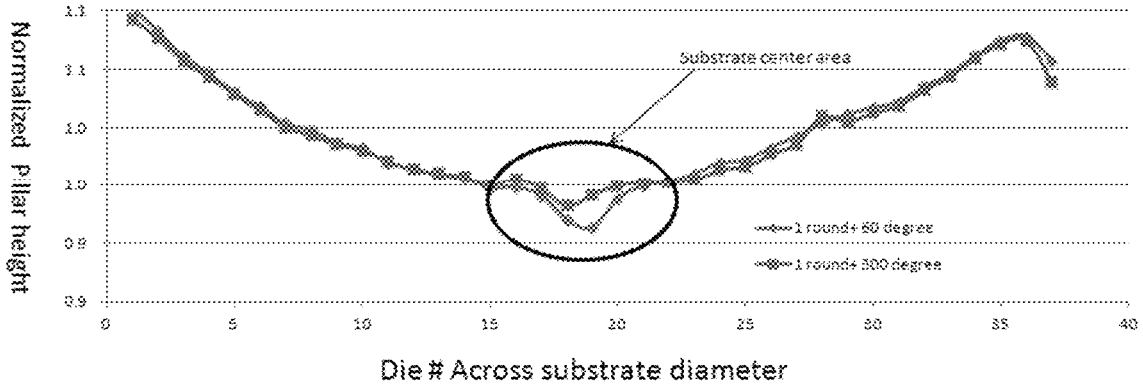
FIG. 21 shows relationship between gap variation and plated pillar height.

Through adjusting the size of the gap, the flow of the substrate center area can be controlled. If the gap is small, the flow rate of the substrate center area is small. Conversely, if the gap is large, the flow rate of the substrate center area is large. The gap is adjusted by turning the adjustable member 50. The adjustable member 50 takes a turn upward or downward, and correspondingly, the size of the gap increases or decreases 1 mm. Please refer to FIG. 21. It can be seen from FIG. 21 that at the substrate center area, the gap is larger, and the average height of plated pillars in one die is higher, which means that the plated pillar height can be controlled by adjusting the size of the gap. At the substrate center area, the gap is larger, and correspondingly the flow is stronger, and correspondingly the plated pillar height is higher, which solves the problem of the plating of the substrate center area.

For more uniform control, including the electric field uniform control and the flow of electrolyte uniform control, the plating apparatus of the present invention includes at least one diffusion plate having a plurality of small apertures. In an exemplary embodiment, the plating apparatus has two diffusion plates fixed on the top of the membrane frame 14. Please refer to FIG. 5, FIG. 6, FIG. 13 and FIG. 14. A first diffusion plate 60 has a plurality of apertures 61. In one embodiment, the apertures 61 are of uniform size and the density of the apertures 61 distributed on the first diffusion plate 60 is also uniform. The diameter of the apertures 61 is 0.5 mm to 5 mm. In another embodiment, the density of the apertures 61 distributed on the first diffusion plate 60 is uniform, but the diameter of the apertures 61 may be different. Specifically, the diameter of the apertures 61 distributed at the center region of the first diffusion plate 60 is larger than the diameter of the apertures 61 distributed at the edge region of the first diffusion plate 60, which can enhance the electric field intensity of the center region, further raising the plating rate of the substrate center area. The material of the first diffusion plate 60 can be PVC, PP, PEEK, PVDF, PFA, Teflon, etc. The thickness of the first diffusion plate 60 is 2 mm to 20 mm. A second diffusion plate 70 has a plurality of apertures 71. In one embodiment, the apertures 71 are of uniform size and the density of the apertures 71 distributed on the second diffusion plate 70 is uniform. The diameter of the apertures 71 is 0.5 mm to 5 mm. In another embodiment, the density of the apertures 71 distributed on the second diffusion plate 70 is uniform, but the diameter of the apertures 71 may be different. Specifically, the diameter of the apertures 71 distributed at the center region of the second diffusion plate 70 is larger than the diameter of the apertures 71 distributed at the edge region of the second diffusion plate 70, which can enhance the electric field intensity of the center region, further raising the plating rate of the substrate center area. The material of the second diffusion plate 70 can be PVC, PP, PEEK, PVDF, PFA, Teflon, etc. The thickness of the second diffusion plate 70 is 2 mm to 20 mm. The first diffusion plate 60 and the second diffusion plate 70 can be the same or not. Preferably, the density of the apertures 61 distributed on the first diffusion plate 60 is greater than the density of the apertures 71 distributed on the second diffusion plate 70, and the first diffusion plate 60 is set above the second diffusion plate 70. Since the second diffusion plate 70 is closer to the membrane 13 and the annular anodes 113, it can control the distribution of electric field so that the redistribution of electric field can be realized and the problem of edge effect can be solved. Due to the photoresist on the substrate and the resistance of seed layer, the resistance at the substrate center area is larger, and the closer the edge of the substrate, the less resistance. Therefore, the second diffusion plate 70 is mainly to adjust the electric field in the circuit. The diameter of the apertures 71 distributed at the center region of the second diffusion plate 70 is larger, which is 4 mm. The diameter of the apertures 71 gradually decreases from the center to edge of the second diffusion plate 70. The diameter of the apertures 71 distributed at the edge of the second diffusion plate 70 is 2.5 mm. In this way, the electric field of the center will be enhanced and the electric field of the edge will be weakened, solving the problem of edge effect. The first diffusion plate 60 is closer to the substrate and is mainly to achieve smooth flow and fluid distribution. But considering the distance effect of electric field distribution, the distance between the first diffusion plate 60 and the second diffusion plate 70 cannot be too large. If the distance between the first diffusion plate 60 and the second diffusion plate 70 is too large, the electric field distribution effect of the second diffusion plate 70 is obviously weakened. The distance between the first diffusion plate 60 and the second diffusion plate 70 is 1 mm to 20 mm.

Figure 5:
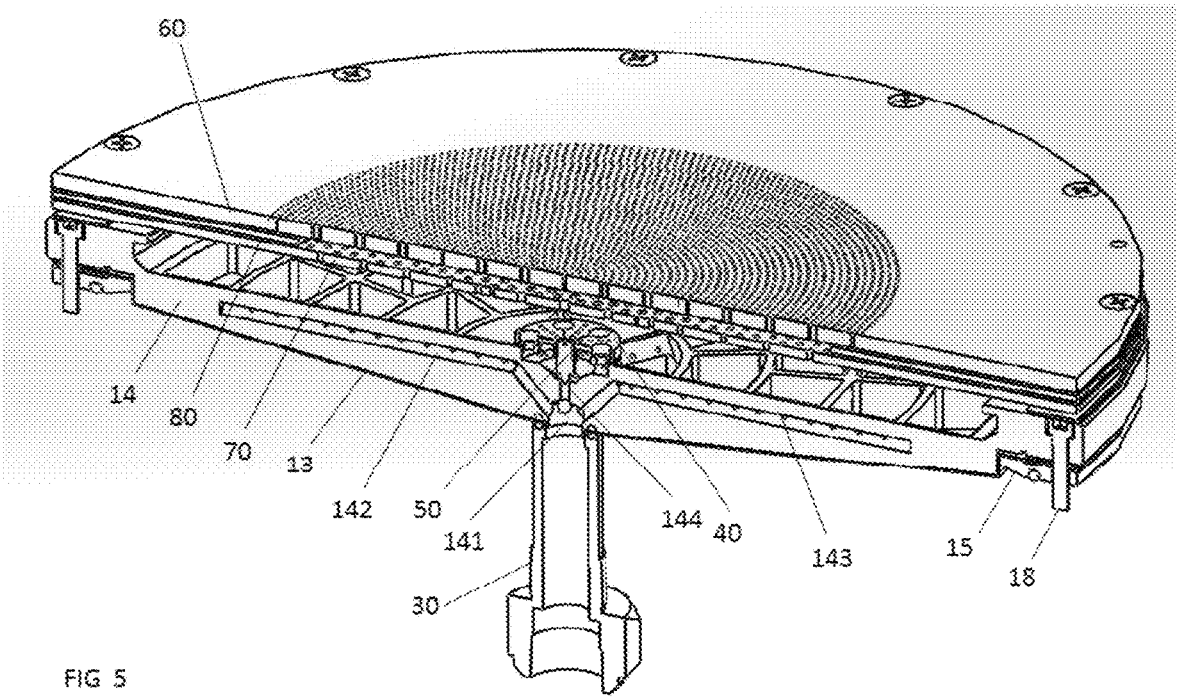
FIG. 5 is a cross-sectional view of a part assembly of the plating apparatus shown in FIG. 1.
Figure 6:
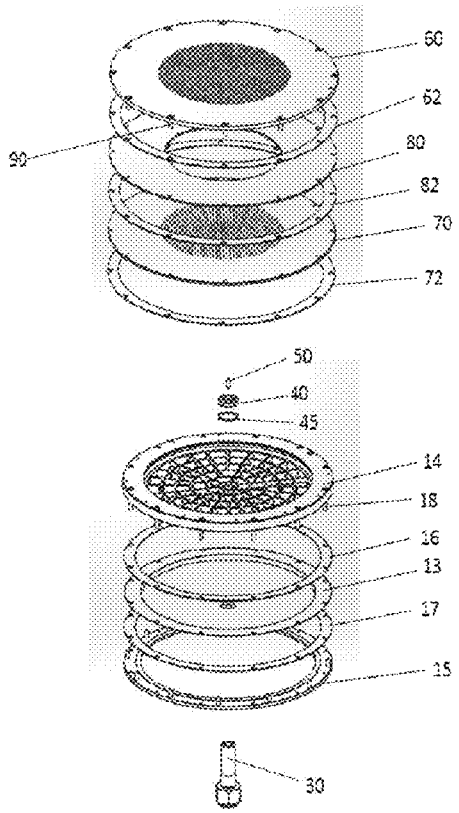
FIG. 6 is an exploded view of the part assembly of the plating apparatus shown in FIG. 5.
Figure 7:
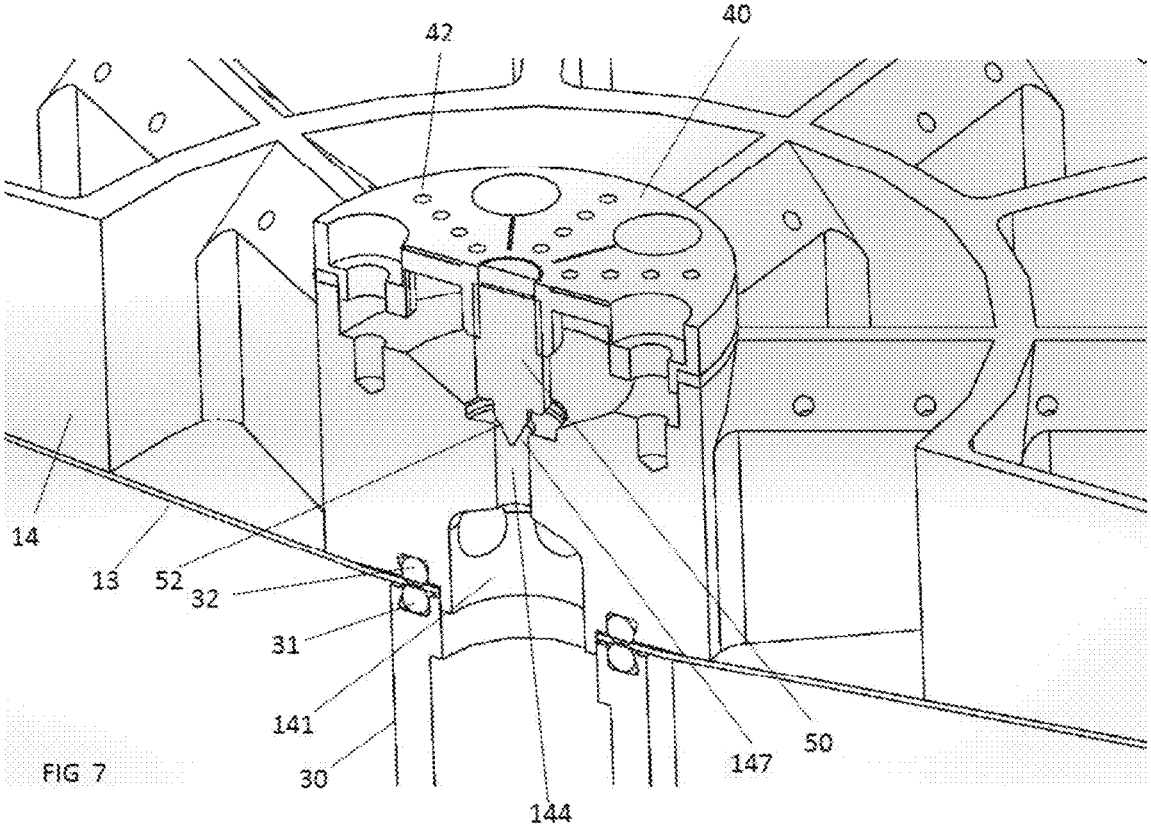
FIG. 7 is a partial enlarged view of the part assembly of the plating apparatus shown in FIG. 5.

As shown in FIG. 5 and FIG. 6, an annular middle plate 80 is set between the first diffusion plate 60 and the second diffusion plate 70 for controlling the height of plated pillars at the edge area of the substrate. A seal ring 62 is set between the first diffusion plate 60 and the middle plate 80. Another seal ring 82 is set between the middle plate 80 and the second diffusion plate 70. Another seal ring 72 is set between the second diffusion plate 70 and the top of the membrane frame 14. A plurality of locating members 90 is used to fix the first diffusion plate 60, the seal ring 62, the middle plate 80, the seal ring 82, the second diffusion plate 70 and the seal ring 72 on the top of the membrane frame 14.

Figure 15A:
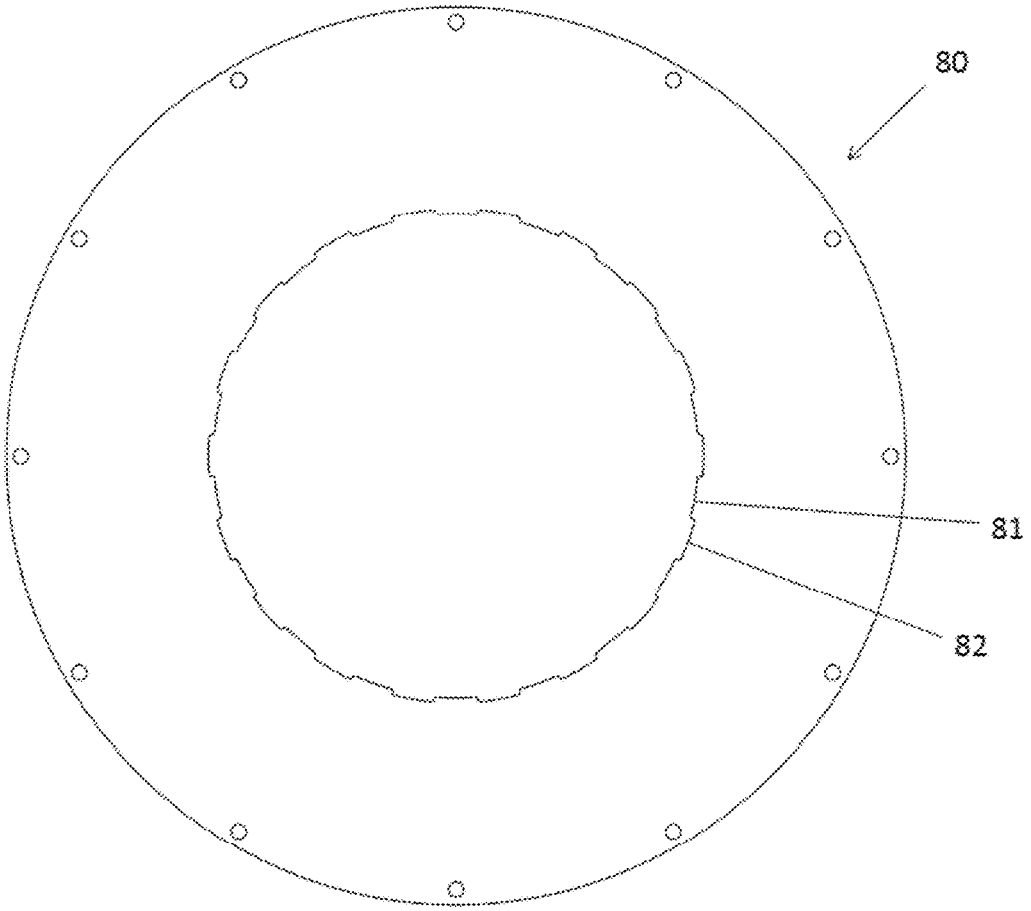
FIG. 15 is a perspective view of a middle plate of the plating apparatus.

As shown in FIG. 15A, preferably, the middle plate 80 has a plurality of convex portions 81 and a plurality of concave portions 82 at the inner edge of the middle plate 80 for improving the uniformity of the plated pillars at the edge of the substrate. The convex portion 81 and the concave portion 82 are arranged alternately. The middle plate 80 is set between the first diffusion plate 60 and the second diffusion plate 70. The convex portions 81 block the corresponding apertures 61 distributed at the edge of the first diffusion plate 60 for preventing electrolyte from passing through these apertures 61. Other apertures 61 distributed at the edge of the first diffusion plate 60 are corresponding to the concave portions 82 and are not blocked so that the electrolyte is capable of passing through these apertures 61 which are not blocked by the middle plate 80. Preferably, half of the apertures 61 distributed at the edge of the first diffusion plate 60 are blocked by the convex portions 81 of the middle plate 80 and the other half of the apertures 61 distributed at the edge of the first diffusion plate 60 are not blocked.

Figure 15B:
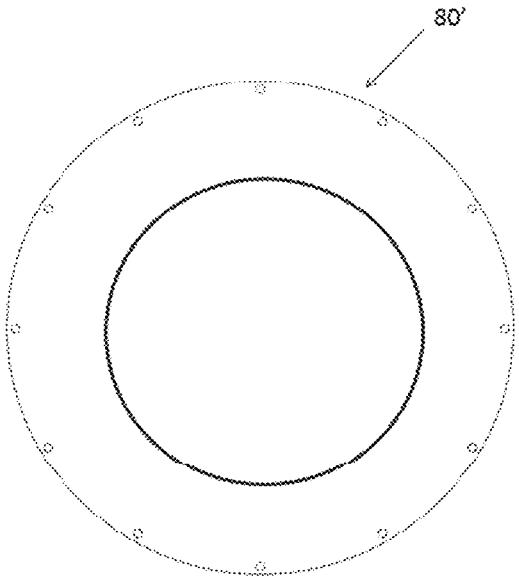
Figure 15C:
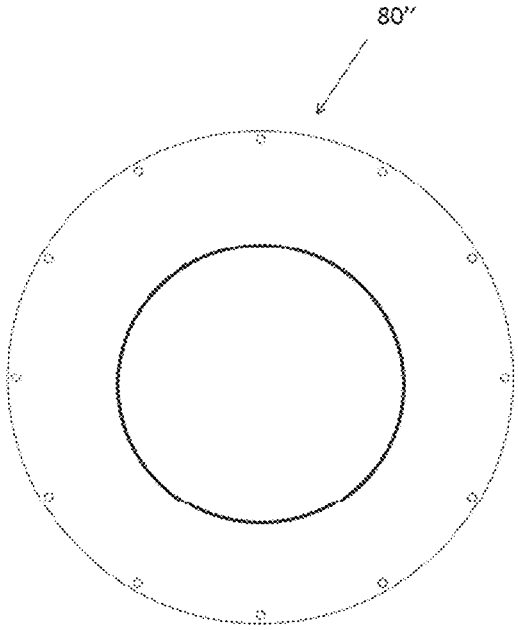
Figure 16:
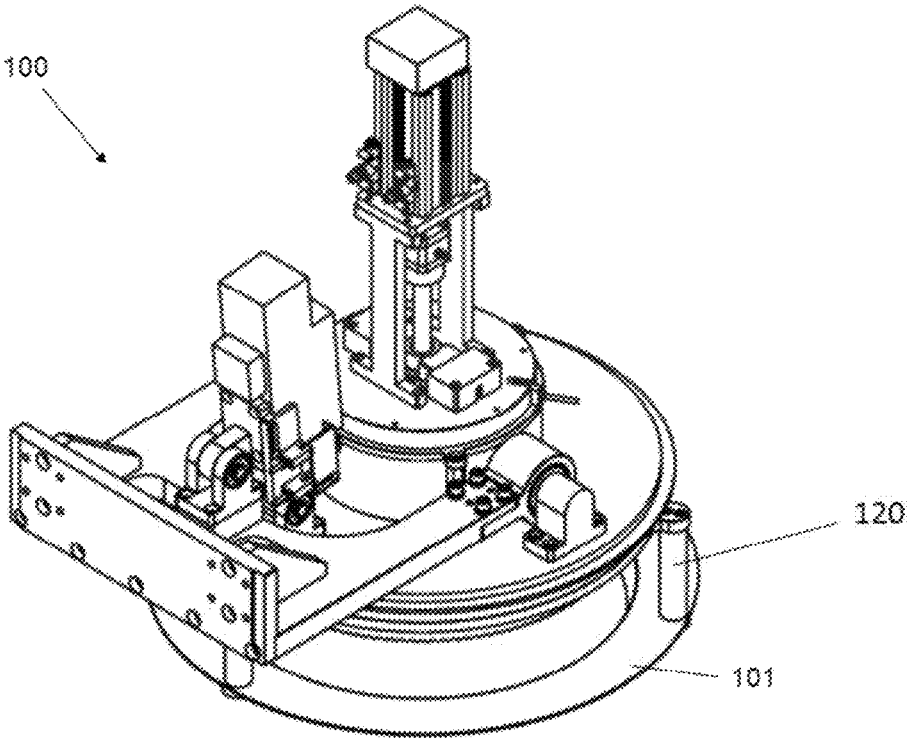
FIG. 16 is a perspective view of a chuck of the plating apparatus.
Figure 17:
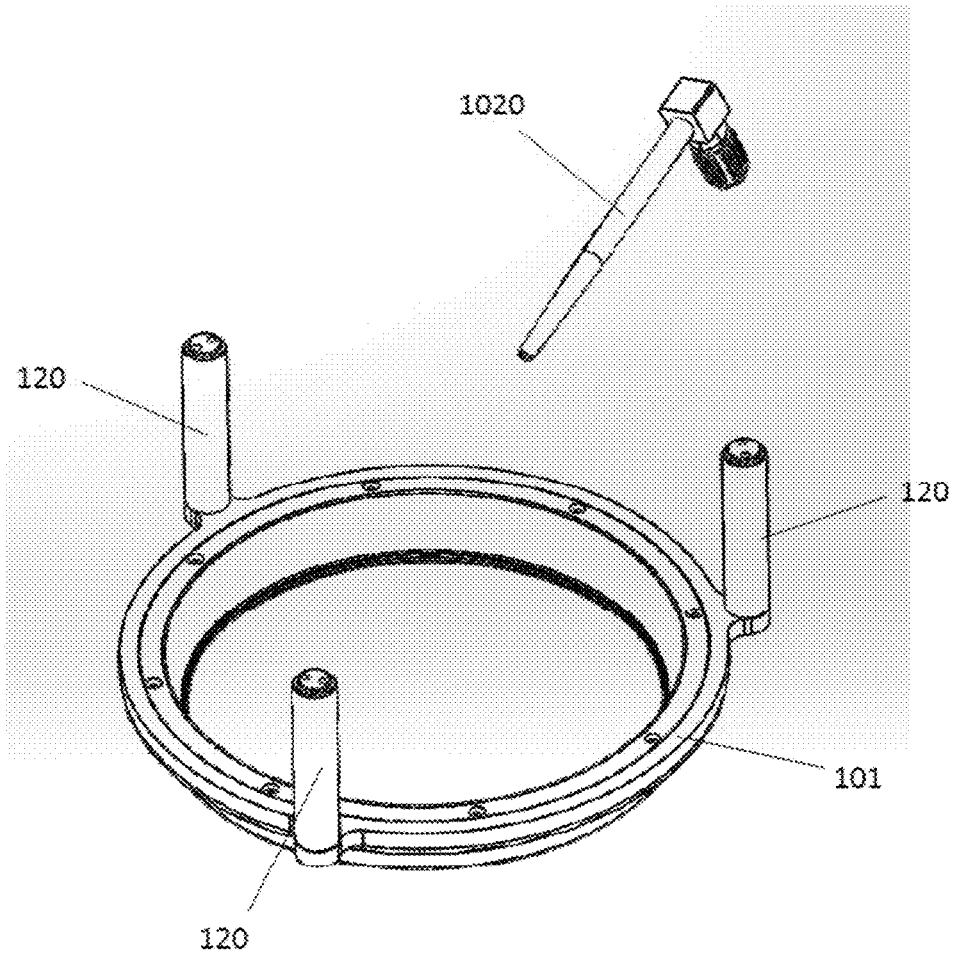
FIG. 17 is a perspective view showing a chuck cleaning nozzle for cleaning the chuck.
Figure 18:
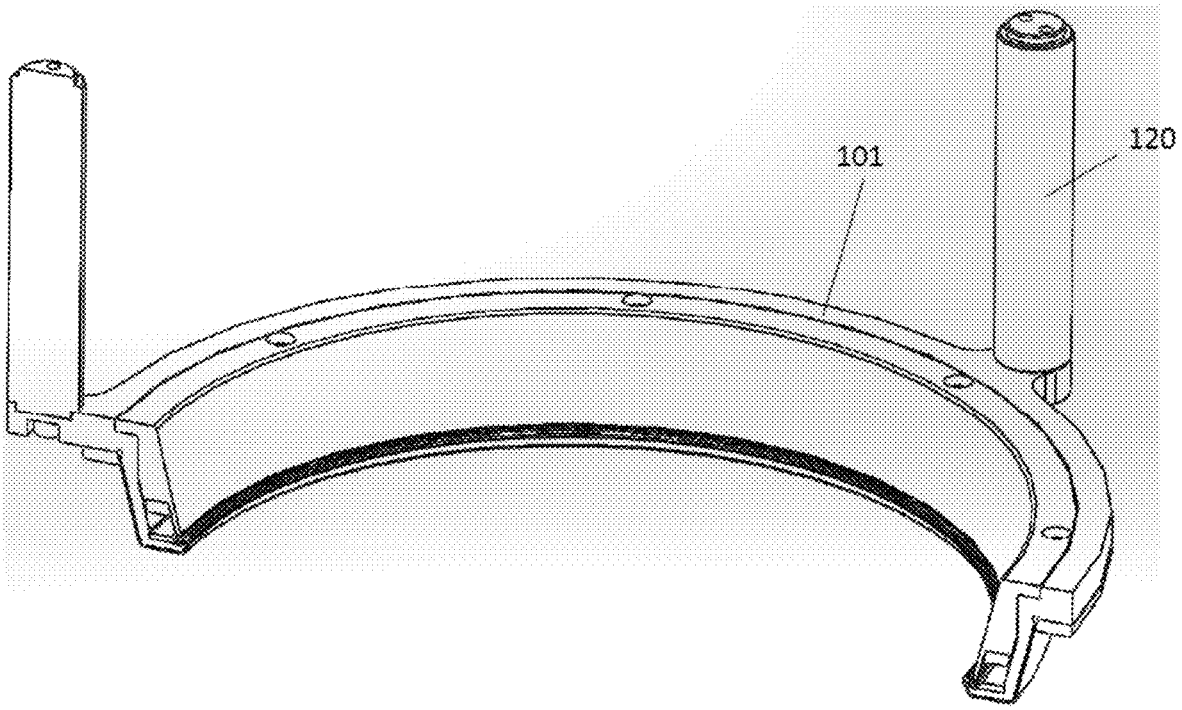
FIG. 18 is a cross-sectional view of the chuck.
Figure 19:
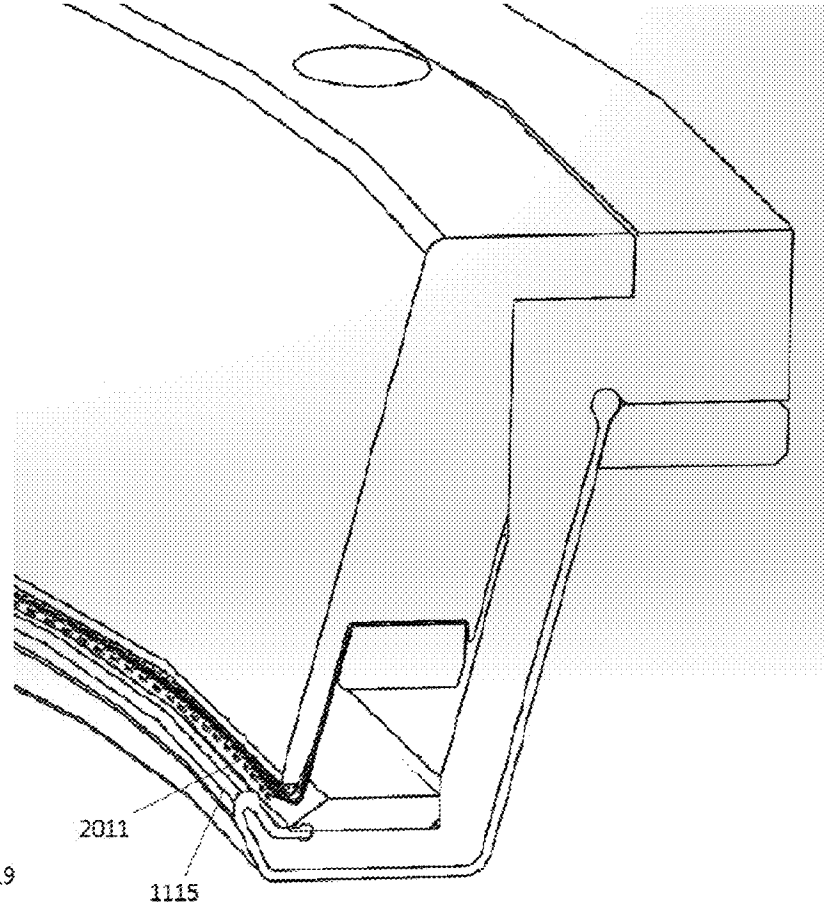
FIG. 19 is a partial enlarged view of the chuck shown in FIG. 18.
Figure 22:
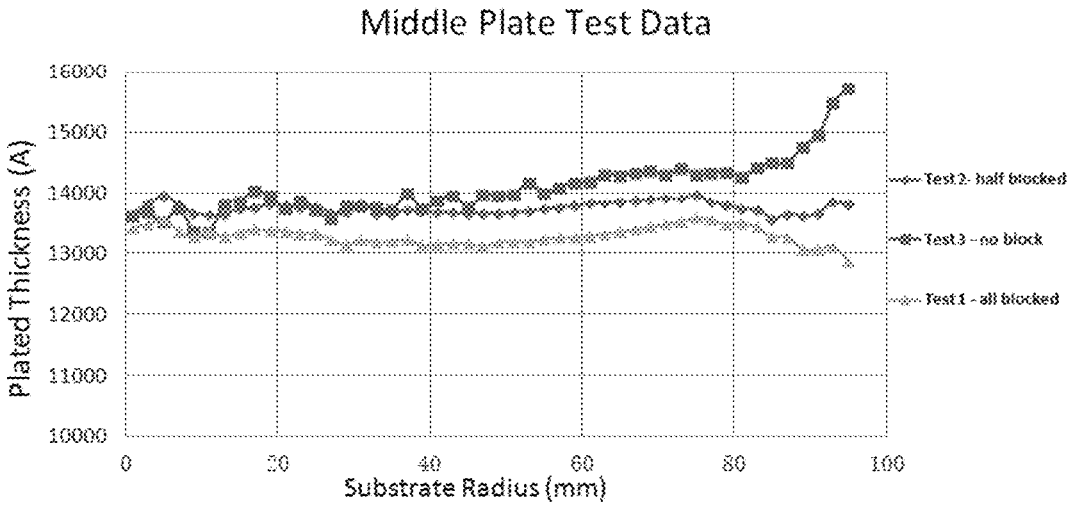
FIG. 22 shows an edge plating data by using the middle plate.
Figure 23:
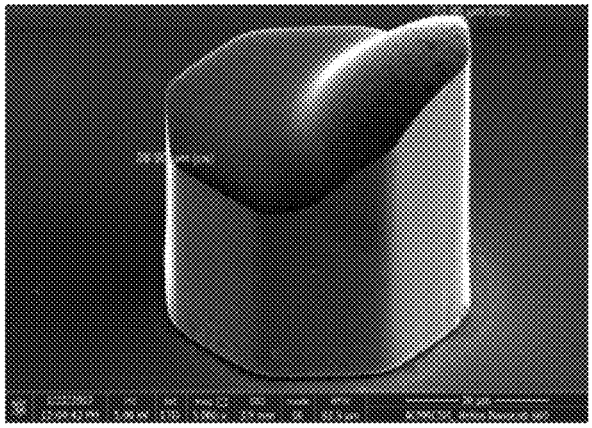
FIG. 23 shows an abnormal shape of a copper pillar.
Figure 24:
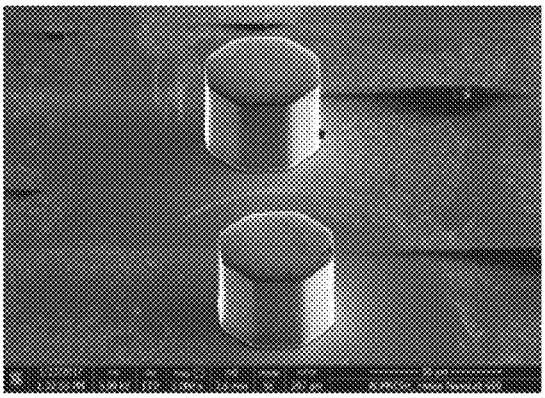
FIG. 24 shows a normal shape of copper pillars.

FIG. 15A shows the middle plate 80 with a plurality of convex portions 81 and a plurality of concave portions 82 so that half of the apertures 61 distributed at the edge of the first diffusion plate 60 are blocked by the convex portions 81 of the middle plate 80 and the other half of the apertures 61 distributed at the edge of the first diffusion plate 60 are not blocked. FIG. 15B shows a middle plate 80' which is completely incapable of blocking the apertures 61 distributed at the edge of the first diffusion plate 60 so that the electrolyte is capable of passing through all the apertures 61 distributed at the edge of the first diffusion plate 60. FIG. 15C shows a middle plate 80" which is capable of blocking all the apertures 61 distributed at the edge of the first diffusion plate 60 so that the electrolyte cannot pass through these apertures 61. It can be seen from FIG. 22 that the middle plate mainly brings an influence on the plated thickness at the edge of the substrate. Under the condition that all the apertures 61 distributed at the edge of the first diffusion plate 60 are blocked, since the edge power line is decreasing, the plated thickness at the edge of the substrate is lower than the other area of the substrate. Conversely, under the condition that all the apertures 61 distributed at the edge of the first diffusion plate 60 are not blocked, the plated thickness at the edge of the substrate is higher than the other area of the substrate. Under the two conditions described above, the height of the plated pillars at the edge of the substrate is not within the scope of process requirement, which causes the yield loss. The present invention utilizes the middle plate 80 with a plurality of convex portions 81 and a plurality of concave portions 82 to selectively block a part of the apertures 61 distributed at the edge of the first diffusion plate 60. The plated thickness on the entire substrate is substantially uniform and within the scope of process requirement. Therefore, the plated thickness at the edge of the substrate can be well controlled.

Referring to FIG. 4, the cathode chamber 12 has an inner side wall 121 and an outer side wall 122. A recess trough 123 is formed between the inner side wall 121 and the outer side wall 122. The top of the inner side wall 121 has notches 124. The bottom of the recess trough 123 defines catholyte outlets 125. The electrolyte of the cathode chamber 12 flows through the notches 124 to be received in the recess trough 123 and drained through the catholyte outlets 125. A substrate rinse nozzle 126 is positioned in the cathode chamber 12 for cleaning the plated film of the substrate.

Figure 2:
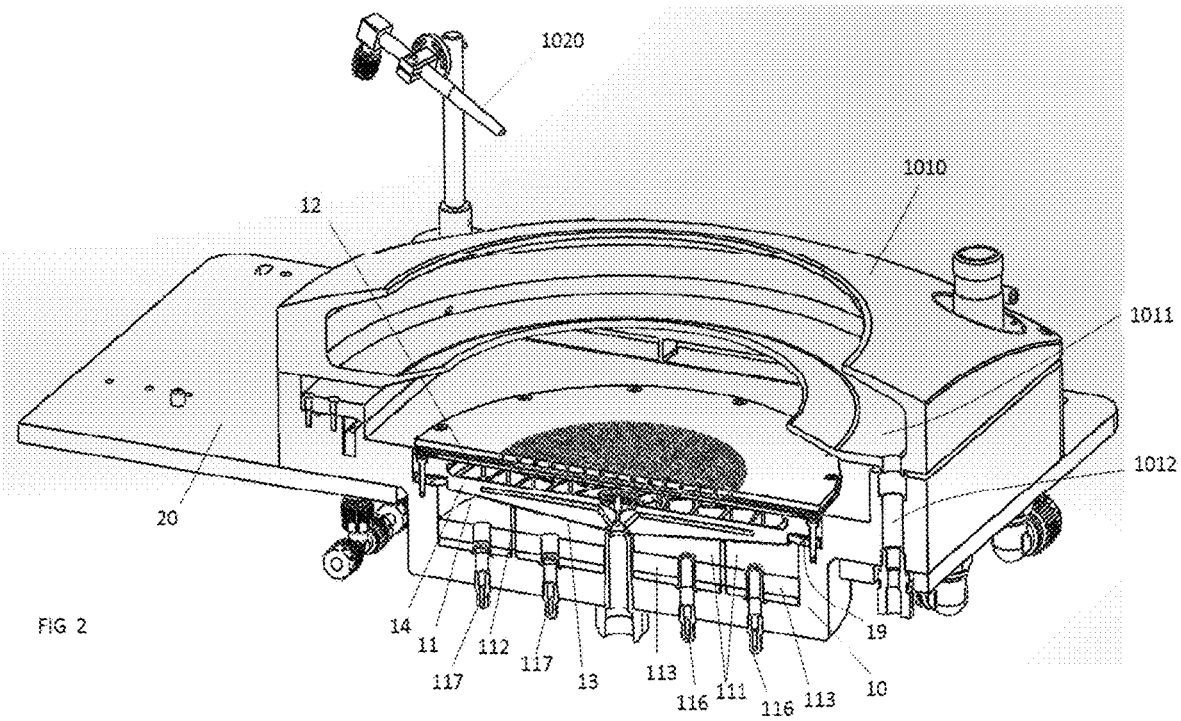
FIG. 2 is a cross-sectional view of the plating apparatus shown in FIG. 1.
Figure 3:
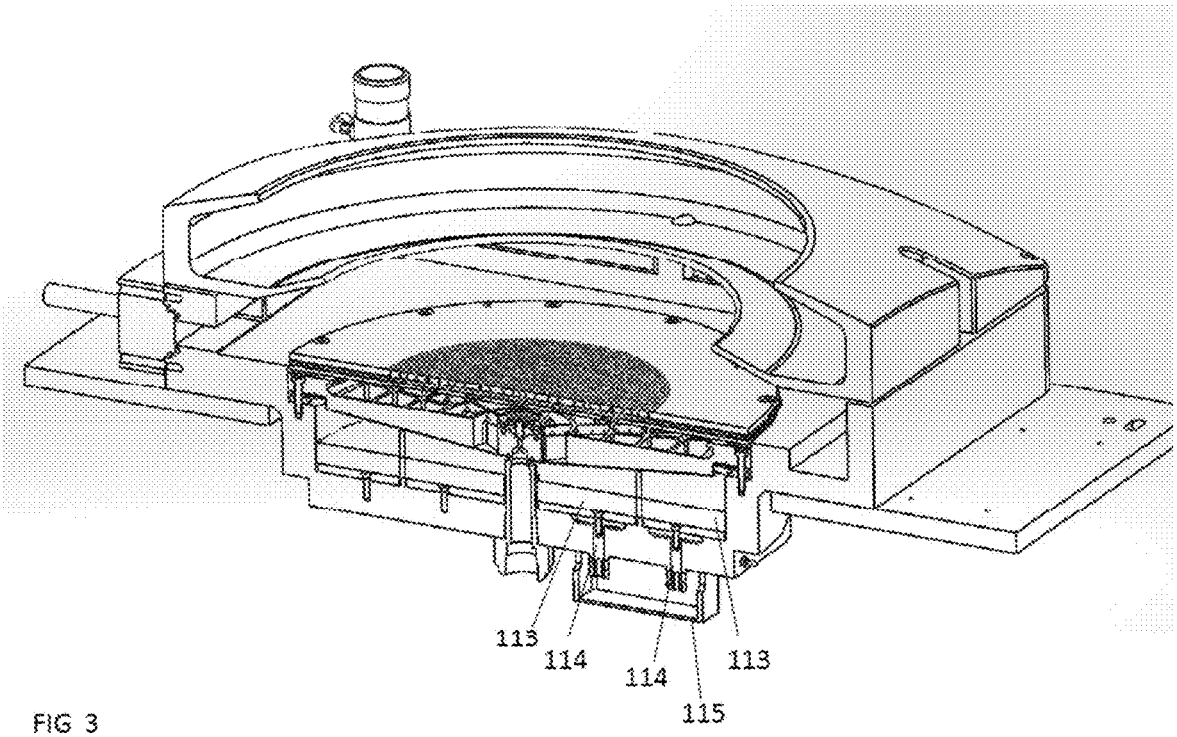
FIG. 3 is another cross-sectional view of the plating apparatus shown in FIG. 1.

Referring to FIG. 2, a shroud 1010 is fixed on the top of the cathode chamber 12 for avoiding the electrolyte splash while plating. The shroud 1010 has a collecting groove 1011. A drain passage 1012 is connected to the collecting groove 1011. Liquid in the collecting groove 1011 is drained through the drain passage 1012. A side wall of the shroud 1010 defines a cleaning liquid inlet 1013 for cleaning the collecting groove 1011. A gas vent 1030 is connected to the cathode chamber 12 for gas exhaust. The plating apparatus can also include a level sensor 1040 for monitoring the liquid level of the cathode chamber 12.

A chuck cleaning nozzle 1020 is positioned above the shroud 1010 for spraying cleaning liquid to clean a chuck 100 which is used for holding the substrate for plating. While cleaning the chuck 100, the cleaning liquid sprayed from the chuck cleaning nozzle 1020 is collected by the collecting groove 1011 of the shroud 1010 and drained through the drain passage 1012. The chuck 100 is described in detail in the PCT patent application number PCT/CN2015/096402, filed on Dec. 4, 2015, which is hereby incorporated by reference.

Referring to FIG. 16 to FIG. 19, the chuck 100 has a chuck cup 101, three upright columns 120 positioned on the top of the chuck cup 101 for supporting and electric transmission, a conduct ring having a plurality of finger portions 2011 which contact with the edge of the front side of the substrate, and a seal shell having a lip seal portion 1115 for sealing the edge of the front side of the substrate so that electrolyte cannot get to the edge of the front side of the substrate and the back side of the substrate while the substrate is immersed into the electrolyte for plating. The chuck cleaning nozzle 1020 sprays the cleaning liquid to clean the finger portions 2011 of the conduct ring and the lip seal portion 1115 of the seal shell. After the substrate has been plated, the finger portions 2011 of the conduct ring and the lip seal portion 1115 of the seal shell may have residual plating solution. If residual plating solution is not cleaned in time, the residual plating solution will form crystals. The crystals on the lip seal portion 1115 of the seal shell will affect the seal between the lip seal portion 1115 and the edge of the front side of the substrate, causing the plating solution contacts with the conduct ring, resulting in plated out issue. Therefore, it is necessary to clean the finger portions 2011 of the conduct ring and the lip seal portion 1115 of the seal shell after each piece of the substrate has been plated.

However, since the chuck 100 keeps rotating during the cleaning process, the cleaning liquid sprayed from the chuck cleaning nozzle 1020 will hit the three upright columns 120, causing the cleaning liquid splash. In order to solve this problem, a controller comprising a timer is provided to control an on-off valve which is set on a supply pipeline. The supply pipeline is connected to the chuck cleaning nozzle 1020 for supplying the cleaning liquid to the chuck cleaning nozzle 1020. The controller is configured to control the on-off valve based on the timer to: close the on-off valve during the period that each of the upright columns 120 passes the chuck cleaning nozzle 1020 to stop spraying the cleaning liquid; and open the on-off valve after the upright column 120 has passed the chuck cleaning nozzle 1020 to spray the cleaning liquid. For example, the rotation speed of the chuck 100 is 20 rpm and the time that the chuck 100 turns a circle is 3 s. The chuck 100 has three upright columns 120 and the time that each upright column 120 passes the chuck cleaning nozzle 1020 is 0.1 s. The on-off valve is closed for 0.1 s when a first upright column passes the chuck cleaning nozzle 1020. Then the on-off valve is opened for 0.9 s. Then the on-off valve is closed for 0.1 s again when a second upright column passes the chuck cleaning nozzle 1020. Then the on-off valve is opened for 0.9 s again. Then the on-off valve is closed for 0.1 s again when a third upright column passes the chuck cleaning nozzle 1020. Repeat in this way, avoiding the cleaning liquid hitting the upright columns 120.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plating apparatus for depositing metal on a substrate, comprising:

a membrane frame, having a center passage which passes through the center of the membrane frame, a catholyte inlet connecting to the center passage, a holding cavity, and a plurality of branch pipes extending from the center to edge of the membrane frame, wherein every branch pipe is connected to the catholyte inlet, every branch pipe has a plurality of spray holes, and the holding cavity is connected to a top end of the center passage;

a catholyte inlet pipe, connecting to the catholyte inlet of the membrane frame;

a center cap, fixed at the holding cavity and covering over the center passage of the membrane frame, the top of the center cap having a plurality of first holes;

wherein the catholyte inlet pipe supplies catholyte to the center cap through the center passage of the membrane frame, and the catholyte is supplied to a center area of the substrate through the first holes of the center cap; and an anode chamber and a cathode chamber, the anode chamber and the cathode chamber being separated by a membrane which is positioned on the membrane frame, wherein the anode chamber has a side wall, the side wall of the anode chamber defines a plurality of discharge holes, every discharge hole is connected to a discharge passage, wherein the anode chamber is divided into multiple anode zones and every two adjacent anode zones are separated by a vertically arranged partition, every anode zone accommodates an annular anode, every anode zone has an independent anolyte inlet and an independent anolyte outlet.

2. The plating apparatus according to claim 1, wherein the flow of the catholyte supplied to the center cap is adjustable and controlled independently.

3. The plating apparatus according to claim 1, wherein the center cap has a through-hole defined at the center of the center cap, an adjustable member is inserted in the through-hole of the center cap and located at a top end of the center passage of the membrane frame, the adjustable member is configured to regulate the flow of the catholyte supplied to the center cap.

4. The plating apparatus according to claim 3, wherein the adjustable member has a base body and a blocking component formed at the bottom of the base body.

5. The plating apparatus according to claim 4, wherein the top of the base body defines a groove-shaped opening for conveniently rotating the adjustable member, the adjustable member is capable of moving upward or downward in the through-hole of the center cap for adjusting the size of a gap formed between the blocking component and the center passage, the catholyte is supplied to the center cap through the gap.

6. The plating apparatus according to claim 3, wherein the adjustable member is a set screw.

7. The plating apparatus according to claim 1, wherein the diameter of the first holes or the density of the first holes is same.

8. The plating apparatus according to claim 1, wherein the diameter of the first holes or the density of the first holes is different.

9. The plating apparatus according to claim 1, wherein the diameter of the first holes gradually increases from the center to edge of the center cap or the density of the first holes gradually increases from the center to edge of the center cap.

10. The plating apparatus according to claim 1, wherein the center cap has a side wall, the side wall of the center cap has a plurality of second holes, the opening direction of every second hole is obliquely upward.

11. The plating apparatus according to claim 1, wherein the diameter or the density of the plurality of spray holes on each branch pipe is same.

12. The plating apparatus according to claim 1, wherein the diameter or the density of the plurality of spray holes on each branch pipe is different.

13. The plating apparatus according to claim 1, wherein the diameter or the density of the spray holes gradually increases from the center to edge of the membrane frame.

14. The plating apparatus according to claim 1, wherein the opening direction of every spray hole is tilted relative to a vertical plane.

15. The plating apparatus according to claim 14, wherein the plurality of spray holes on each branch pipe is divided into two groups, the opening directions of the two groups of spray holes are opposite.

16. The plating apparatus according to claim 1, further comprising at least one diffusion plate having a plurality of apertures, the at least one diffusion plate being fixed on the membrane frame.

17. The plating apparatus according to claim 16, wherein the apertures on the diffusion plate are of uniform size and the density of the apertures distributed on the diffusion plate is uniform.

18. The plating apparatus according to claim 16, wherein the density of the apertures distributed on the diffusion plate is uniform, but the diameter of the apertures distributed at the center region of the diffusion plate is larger than the diameter of the apertures distributed at the edge region of the diffusion plate.

19. The plating apparatus according to claim 16, wherein the number of the diffusion plates is two, the two diffusion plates are respectively defined as a first diffusion plate and a second diffusion plate, the first diffusion plate is set above the second diffusion plate, a distance is formed between the two diffusion plates.

20. The plating apparatus according to claim 19, wherein the density of the apertures distributed on the first diffusion plate is greater than the density of the apertures distributed on the second diffusion plate.

21. The plating apparatus according to claim 19, further comprising an annular middle plate being set between the two diffusion plates, the middle plate having a plurality of convex portions and a plurality of concave portions at the inner edge of the middle plate.

22. The plating apparatus according to claim 21, wherein the convex portion and the concave portion are arranged alternately.

23. The plating apparatus according to claim 21, wherein half of the apertures distributed at the edge of the first diffusion plate are blocked by the convex portions of the middle plate and the other half of the apertures distributed at the edge of the first diffusion plate are not blocked.

24. The plating apparatus according to claim 1, wherein the vertical position of the plurality of branch pipes in the membrane frame is not higher than the vertical position of the center cap in the membrane frame.

25. The plating apparatus according to claim 1, wherein there is a distance between the top of the partitions and the membrane for gas bubbles passing through, the gas bubbles in the anode zones are collected and guided by the membrane to the discharge holes and discharged out from the discharge passages.

26. The plating apparatus according to claim 25, further comprising a third valve which is set on an anolyte inlet pipe connected to the anolyte inlet, and a second valve which is set on a discharge pipe connected to the discharge passage, wherein an anode electrolyte is supplied to the anode zones through the anolyte inlet pipes and the anolyte inlets and then discharged through the discharge holes, discharge passages and the discharge pipes.

27. The plating apparatus according to claim 25, further comprising a first valve which is set on a DIW inlet pipe and a fifth valve which is set on a DIW outlet pipe, wherein the DIW inlet pipe is connected to the discharge passage, the DIW outlet pipe is connected to the anolyte outlet, wherein DIW is supplied to the anode zones to flush the annular anodes through the DIW inlet pipes, the discharge passages and the discharge holes and then drained through the anolyte outlets and the DIW outlet pipes.

28. The plating apparatus according to claim 1, further comprising a fourth valve which is set on an anolyte outlet pipe connected to the anolyte outlet, wherein an anode electrolyte in the anode zones is drained through the anolyte outlets and the anolyte outlet pipes.

29. The plating apparatus according to claim 1, wherein the cathode chamber has an inner side wall and an outer side wall, a recess trough is formed between the inner side wall and the outer side wall, the top of the inner side wall has notches, the bottom of the recess trough has catholyte outlets, an electrolyte of the cathode chamber flows through the notches to be received in the recess trough and drained through the catholyte outlet.

30. The plating apparatus according to claim 1, further comprising a substrate rinse nozzle being positioned in the cathode chamber for cleaning plated film of the substrate.

31. The plating apparatus according to claim 1, further comprising a shroud fixed on the top of the cathode chamber.

32. The plating apparatus according to claim 31, wherein the shroud has a collecting groove, a drain passage is connected to the collecting groove, liquid in the collecting groove is drained through the drain passage.

33. The plating apparatus according to claim 32, wherein a side wall of the shroud defines a cleaning liquid inlet for cleaning the collecting groove.

34. The plating apparatus according to claim 31, further comprising a chuck cleaning nozzle positioned above the shroud for cleaning a chuck which holds the substrate for plating.

35. The plating apparatus according to claim 34, wherein the chuck has a plurality of upright columns.

36. The plating apparatus according to claim 35, further comprising a controller having a timer, an on-off valve being set on a supply pipeline which is connected to the chuck cleaning nozzle for supplying cleaning liquid to the chuck cleaning nozzle, wherein the controller is configured to control the on-off valve based on the timer to:

close the on-off valve during the period that each of the upright columns passes the chuck cleaning nozzle to stop spraying the cleaning liquid; and open the on-off valve after the upright column has passed the chuck cleaning nozzle to spray the cleaning liquid.

37. The plating apparatus according to claim 1, further comprising a gas vent connecting to the cathode chamber for gas exhaust.

* * * * *